US012442366B2

(12) United States Patent
Sato et al.

(10) Patent No.: US 12,442,366 B2
(45) Date of Patent: Oct. 14, 2025

(54) GAS COMPRESSOR

(71) Applicant: MAX CO., LTD., Tokyo (JP)

(72) Inventors: Masaki Sato, Tokyo (JP); Hirotaka Saiki, Tokyo (JP)

(73) Assignee: Max Co., Ltd., Tokyo (JP)

( * ) Notice: Subject to any disclaimer, the term of this patent is extended or adjusted under 35 U.S.C. 154(b) by 154 days.

(21) Appl. No.: 18/139,087

(22) Filed: Apr. 25, 2023

(65) Prior Publication Data

US 2023/0354532 A1 Nov. 2, 2023

(30) Foreign Application Priority Data

Apr. 28, 2022 (JP) ..... 2022-074681

(51) Int. Cl.

| | |
|---|---|
| ***F04B 39/12*** | (2006.01) |
| ***F04B 27/00*** | (2006.01) |
| ***F04B 35/04*** | (2006.01) |
| ***F04B 35/06*** | (2006.01) |
| ***F04B 39/06*** | (2006.01) |
| ***F04B 41/02*** | (2006.01) |
| ***F04B 53/06*** | (2006.01) |
| ***F04B 53/16*** | (2006.01) |

(52) U.S. Cl.

CPC ..... *F04B 39/121* (2013.01); *F04B 35/04* (2013.01); *F04B 35/06* (2013.01); *F04B 39/066* (2013.01); *F04B 27/005* (2013.01); *F04B 41/02* (2013.01); *F04B 53/06* (2013.01); *F04B 53/16* (2013.01)

(58) Field of Classification Search

CPC ..... F04B 39/121; F04B 35/04; F04B 35/06; F04B 39/066; F04B 27/005; F04B 41/02; F04B 53/06; F04B 53/16

See application file for complete search history.

(56) References Cited

U.S. PATENT DOCUMENTS

| | | | | |
|---|---|---|---|---|
| 8,770,341 | B2 | 7/2014 | Wood et al. | |
| 2008/0003112 | A1 | 1/2008 | Schuetzle et al. | |
| 2008/0112823 | A1* | 5/2008 | Yoshida | F04B 35/06 417/410.1 |
| 2009/0194177 | A1* | 8/2009 | Yokota | F04B 49/06 137/565.18 |

(Continued)

FOREIGN PATENT DOCUMENTS

| | | |
|---|---|---|
| JP | 2009024604 A | 2/2009 |
| JP | 2018-071467 A | 5/2018 |
| JP | 2022030007 A | 2/2022 |

OTHER PUBLICATIONS

Sep. 21, 2023—(EP) Extended EP Search Report—EP App 23169828.3.

*Primary Examiner* — David N Brandt

(74) *Attorney, Agent, or Firm* — Banner & Witcoff, Ltd.

(57) ABSTRACT

A gas compressor includes a main body portion including a compression unit configured to compress gas, an air blowing unit, and a drive unit configured to drive the compression unit and the air blowing unit, a cover portion covering at least a part of the main body portion and having an air vent through which air flows from the air blowing unit, and a handle portion having a gripping portion. The air vent faces a rotation axis direction of a rotation member of the air blowing unit which is rotated by being driven by the drive unit, and the handle portion includes a protective portion facing the air vent and being apart from the air vent.

13 Claims, 6 Drawing Sheets

(56) References Cited

U.S. PATENT DOCUMENTS

| | | | | |
|---|---|---|---|---|
| 2013/0209287 | A1* | 8/2013 | Kobori | F04B 35/06 417/415 |
| 2018/0119687 | A1* | 5/2018 | Asai | F04B 35/06 |
| 2022/0042501 | A1 | 2/2022 | Nishido et al. | |
| 2022/0112903 | A1 | 4/2022 | Wang | |

* cited by examiner

GAS COMPRESSOR

CROSS-REFERENCE TO RELATED APPLICATIONS

This application is based upon and claims the benefit of priority from prior Japanese patent application No. 2022-074681, filed on Apr. 28, 2022, the entire contents of which are incorporated herein by reference.

TECHNICAL FIELD

The present disclosure relates to a gas compressor that compresses gas.

BACKGROUND ART

A gas compressor called an air compressor has a configuration in which a compression unit, an electric motor, and a fan are covered with a cover. an air vent for internal cooling is essential for the cover of the air compressor, and the air vent is configured by slits in a lattice shape or a row shape in order to prevent insertion of foreign matters (for example, see JP2018-71467A).

Since the air vent provided in the cover of the air compressor has a narrow portion between the slits, strength of a cover portion is reduced as compared with a portion where the air vent is not provided. On the other hand, in a portable air compressor used in a construction site or the like, a cover may receive an impact due to contact with a tool or a building material. Therefore, a portion of the cover where the air vent is provided is easily damaged. Therefore, it is conceivable to increase a thickness of the portion between the slits to improve the strength by reducing an opening area of the slit in the air vent. However, when the opening area of the slit is reduced, cooling efficiency is decreased.

The present disclosure has been made to solve such a problem, and an object of the present disclosure is to provide a gas compressor capable of protecting a portion of a cover portion where an air vent is provided without lowering cooling efficiency.

SUMMARY

According to an aspect of the disclosure, a gas compressor includes a main body portion including a compression unit configured to compress gas, an air blowing unit, and a drive unit configured to drive the compression unit and the air blowing unit, a cover portion covering at least a part of the main body portion and having an air vent through which air flows from the air blowing unit, and a handle portion having a gripping portion. The air vent faces a rotation axis direction of a rotation member of the air blowing unit which is rotated by being driven by the drive unit, and the handle portion includes a protective portion facing the air vent and being apart from the air vent.

In the present disclosure, the handle portion covers a part of the air vent on the outside of the cover portion, so that the handle portion prevents the air vent from being hit by an object. Further, a space is formed between the handle portion and the air vent by providing the protective portion apart from the air vent, so that the handle portion does not block a flow of air passing through the air vent. Accordingly, compared to a configuration in which an air vent is directly reinforced, the air vent may be protected by the handle portion without lowering the cooling efficiency.

DESCRIPTION OF EMBODIMENTS

Hereinafter, an embodiment of an air compressor as a gas compressor according to the present disclosure will be described with reference to the drawings.

Configuration Example of Air Compressor According to Present Embodiment

Figure 1A:
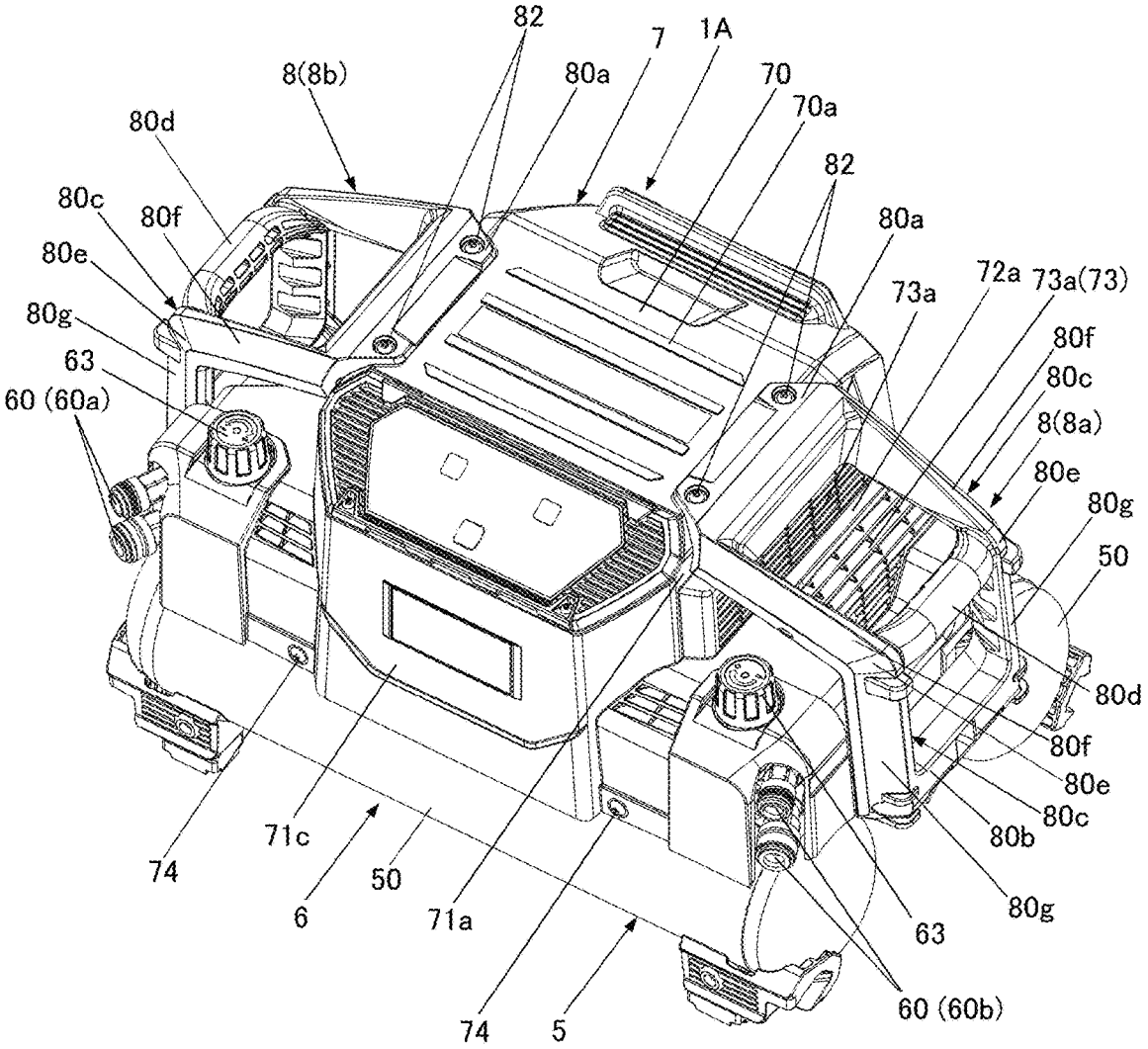
FIG. 1A is a perspective view illustrating an example of an air compressor according to the present embodiment.
Figure 1B:
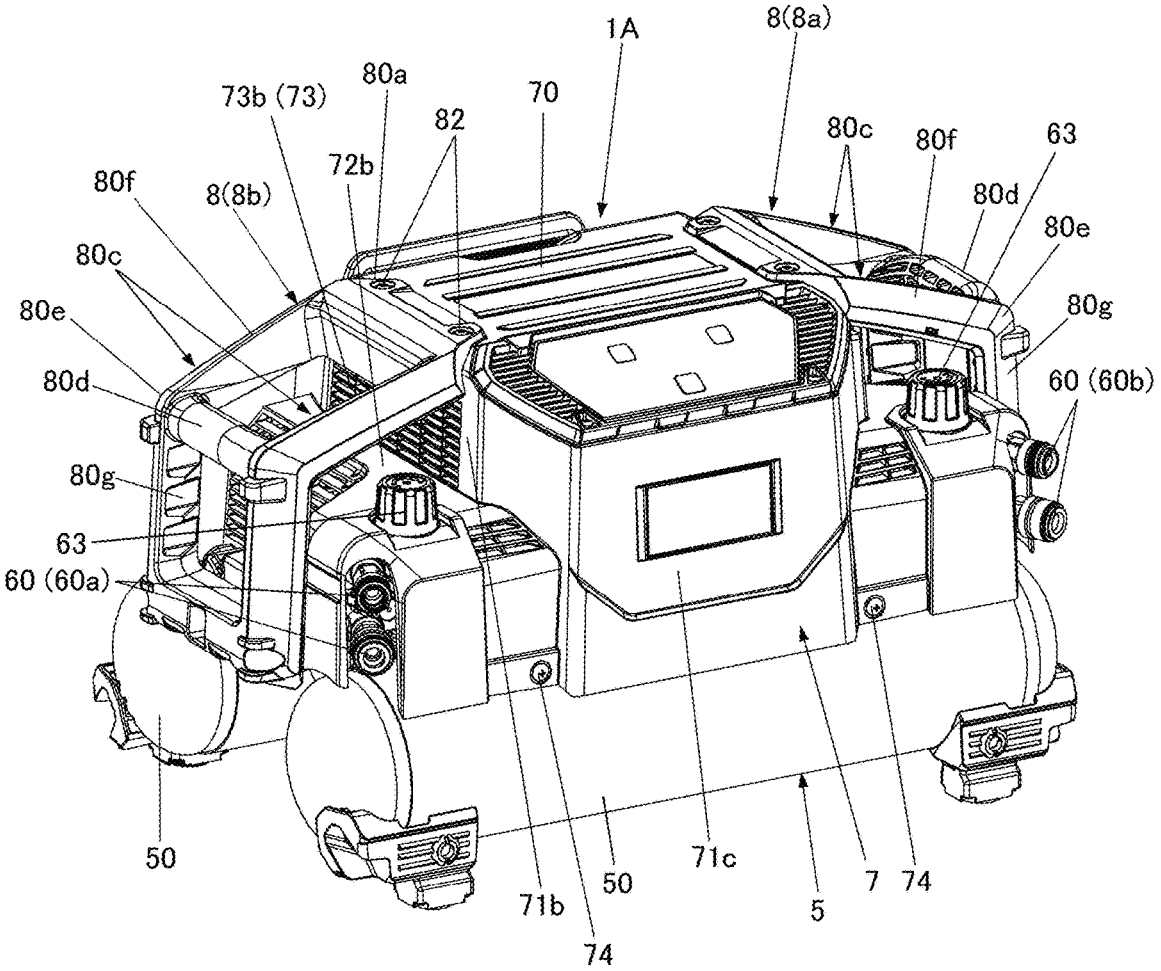
FIG. 1B is a perspective view illustrating the example of the air compressor according to the present embodiment.
Figure 2:
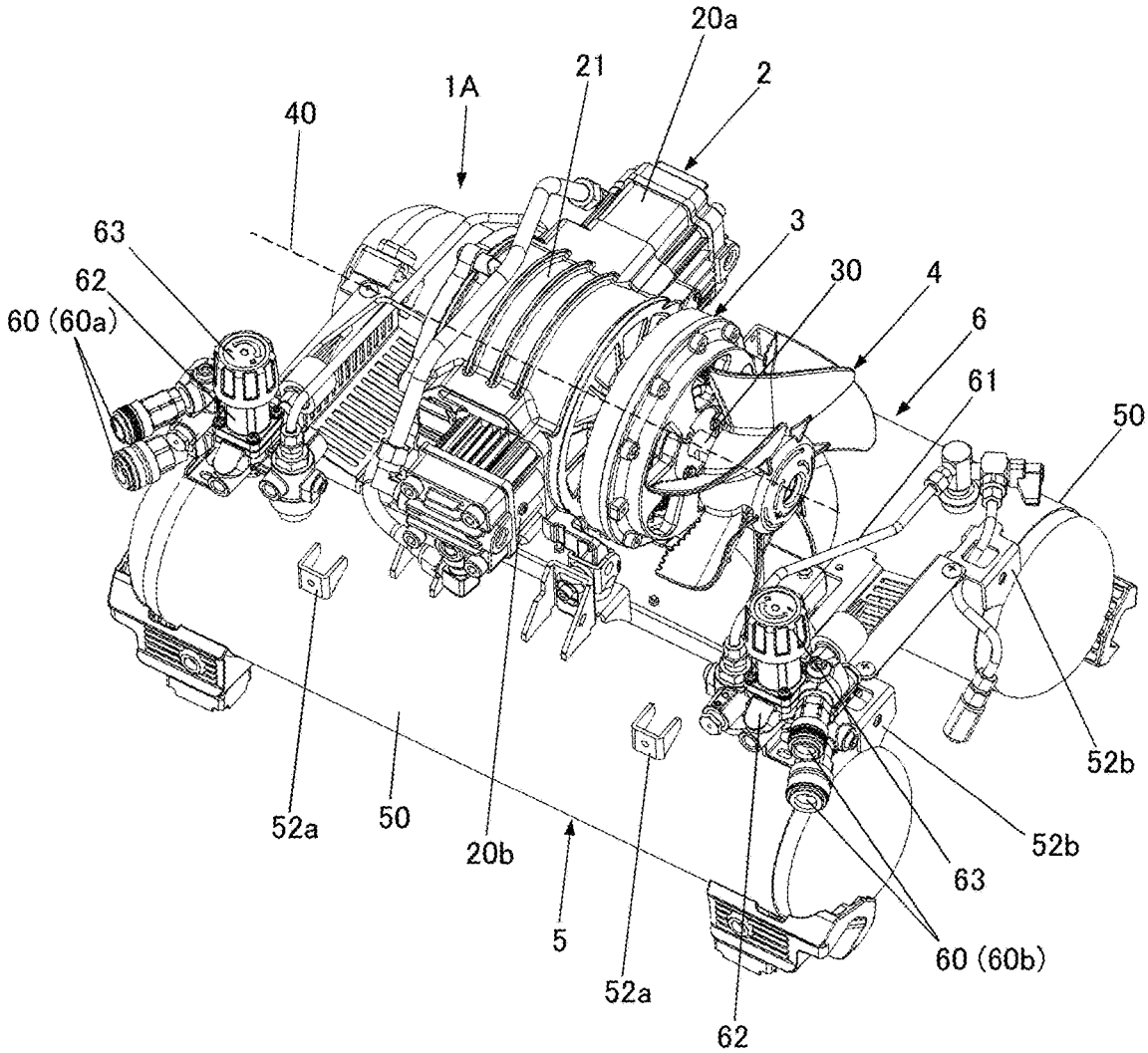
FIG. 2 is a perspective view illustrating the example of the air compressor according to the present embodiment with a cover portion removed.

FIGS. 1A and 1B are perspective views illustrating an example of an air compressor according to the present embodiment. FIG. 2 is a perspective view illustrating the example of the air compressor according to the present embodiment with a cover portion removed.

An air compressor 1A includes a compression unit 2 that compresses air as an example of gas, a drive unit 3 that drives the compression unit 2, an air blowing unit 4 that is driven by the drive unit 3 and generates a flow of air for cooling the compression unit 2 and the drive unit 3, and a storage unit 5 that stores air (compressed air) compressed by the compression unit 2.

The air compressor 1A includes a main body portion 6 including the compression unit 2, the drive unit 3, the air blowing unit 4, and the storage unit 5, a cover portion 7 covering at least a part of the main body portion 6, and a handle portion 8 that may be held by a human hand. An upper-lower direction of the air compressor 1A is determined in consideration of a usage form in which the air compressor 1A is installed in an installation place such as a ground or a floor of a building.

The compression unit 2 includes a primary cylinder 20*a* and a secondary cylinder 20*b*. The primary cylinder 20*a* and the secondary cylinder 20*b* each include a piston (not illustrated). Each piston of the primary cylinder 20*a* and the secondary cylinder 20*b* in the compression unit 2 is coupled to a crank shaft (not illustrated) rotatably supported by a crankcase 21. In the compression unit 2, each piston reciprocates as the crank shaft rotates, and the reciprocating movement of each piston generates compressed air. The compression unit 2 further compresses, by the secondary cylinder 20*b*, air compressed by the primary cylinder 20*a* to generate higher pressure compressed air.

The drive unit 3 is a motor (electric motor) driven by electricity. One side (not illustrated) of a rotating shaft 30 of the drive unit 3 is coupled to the crank shaft of the compression unit 2.

The air blowing unit 4 is formed of an axial fan, and is attached to the other side of the shaft 30 of the drive unit 3.

The air blowing unit 4 is rotated by being driven by the drive unit 3 to generate an air flow from the air blowing unit 4 toward the drive unit 3 and the compression unit 2.

The storage unit 5 includes a plurality of tanks 50 that store compressed air. In the tank 50, a radial direction of a cylindrical shape is a lateral direction, and a direction orthogonal to the radial direction (lateral direction) is a longitudinal direction. The storage unit 5 includes two tanks 50 in this embodiment. The two tanks 50 are arranged side by side in the radial direction such that the longitudinal directions of the tanks 50 are parallel to each other.

In the main body portion 6, the crank shaft (not illustrated) of the compression unit 2 is coupled to the one side of the shaft 30 of the drive unit 3, and the air blowing unit 4 is attached to the other side of the shaft 30 of the drive unit 3. Therefore, in the main body portion 6, a direction in which the shaft 30 of the drive unit 3 extends is a rotation axis direction 40 of the air blowing unit 4, and the compression unit 2, the drive unit 3, and the air blowing unit 4 are arranged coaxially along the rotation axis direction 40 of the air blowing unit 4. Further, the longitudinal direction of each tank 50 and the rotation axis direction 40 (the direction in which the shaft 30 of the drive unit 3 extends) of the air blowing unit 4 are arranged in parallel. A length of the tank 50 in the longitudinal direction is longer than a length of the compression unit 2, the drive unit 3 and the air blowing unit 4 arranged along the rotation axis direction 40 of the air blowing unit 4. As a result, when the longitudinal direction of each tank 50 and the rotation axis direction 40 of the air blowing unit 4 are arranged in parallel, it is easy to secure a space for the handle portion 8 above both ends of the tank 50 along the longitudinal direction, and it is easy to secure a space between the handle portion 8 and the cover portion 7.

In the main body portion 6, the air blowing unit 4 is rotated by being driven by the drive unit 3 to generate an air flow from the air blowing unit 4 toward the drive unit 3 and the compression unit 2 along the rotation axis direction 40 of the air blowing unit 4 indicated by a dashed line in FIG. 2.

The main body portion 6 includes a compressed air outlet 60 for supplying compressed air stored in the tank 50 of the storage unit 5 to a tool (not illustrated). The compressed air outlet 60 is coupled to the tank 50 via a pipe 61. In the embodiment, the air compressor 1A is provided with two compressed air outlets 60, a compressed air outlet 60*a* for supplying high pressure compressed air and a compressed air outlet 60*b* for supplying relatively low pressure compressed air. The compressed air outlet 60*a* and the compressed air outlet 60*b* are each provided with a pressure reducing valve 62 for supplying compressed air reduced to a desired pressure to the tool and a dial 63 for adjusting the pressure.

The cover portion 7 includes an upper surface portion 70, a first side portion 71*a* and a second side portion 71*b* provided on both sides facing the rotation axis direction 40 of the air blowing unit 4, and a third side portion 71*c* and a fourth side portion (not illustrated) provided on both sides facing a direction orthogonal to the rotation axis direction 40 of the air blowing unit 4.

The cover portion 7 has a shape that covers all the compression unit 2, the drive unit 3 and the air blowing unit 4, and an upper part of the storage unit 5 with the upper surface portion 70, the first side portion 71*a* and the second side portion 71*b*, and the third side portion 71*c* and the fourth side portion (not illustrated). The cover portion 7 is fixed by screws 74 to an attachment portion 52*a* provided on a peripheral surface of the tank 50 of the storage unit 5.

The cover portion 7 includes an air vent forming portion 72*a* on the first side portion 71*a*, which is one side portion facing the rotation axis direction 40 of the air blowing unit 4. The air vent forming portion 72*a* is configured such that a portion where the upper surface portion 70 and the first side portion 71*a* are coupled to each other has a recessed shape.

Further, the cover portion 7 includes an air vent forming portion 72*b* on the second side portion 71*b*, which is the other side portion facing the rotation axis direction 40 of the air blowing unit 4. The air vent forming portion 72*b* is configured such that a portion where the upper surface portion 70 and the second side portion 71*b* are coupled to each other has a recessed shape.

The cover portion 7 includes an air vent 73 (first air vent 73*a*) in the air vent forming portion 72*a*. The first air vent 73*a* is configured by providing a plurality of slit-shape openings penetrating the front and back of the first side portion 71*a*.

Further, the cover portion 7 includes an air vent 73 (second air vent 73*b*) in the air vent forming portion 72*b*. The second air vent 73*b* is configured by providing a plurality of slit-shape openings penetrating the front and back of the second side portion 71*b*.

As a result, the air vents 73 (first air vent 73*a* and second air vent 73*b*) are formed on both sides facing the rotation axis direction 40 of the air blowing unit 4. In the main body portion 6, since the air flows from the air blowing unit 4 toward the drive unit 3 and the compression unit 2, the first air vent 73*a* facing the air blowing unit 4 serves as an intake port, and the second air vent 73*b* facing the compression unit 2 serves as an outlet port.

The handle portion 8 includes a handle portion 8*a* that partially covers the first air vent 73*a* and a handle portion 8*b* that partially covers the second air vent 73*b*.

The handle portion 8*a* and the handle portion 8*b* each includes an upper end portion 80*a* fixed to the upper surface portion 70 of the cover portion 7, a lower end portion 80*b* fixed to the storage unit 5 configuring the main body portion 6, two protective portions 80*c* coupling the upper end portion 80*a* and the lower end portion 80*b* and facing the first air vent 73*a* or the second air vent 73*b*, and a gripping portion 80*d* to be held by hand.

The upper end portion 80*a* is coupled to upper end sides of the two protective portions 80*c* such that a distance between the two protective portions 80*c* is approximately equal to a width of the first air vent 73*a* or the second air vent 73*b*. The lower end portion 80*b* is coupled to lower end sides of the two protective portions 80*c* such that the distance between the two protective portions 80*c* is approximately equal to the width of the first air vent 73*a* or the second air vent 73*b*.

The protective portion 80*c* is provided with a bent portion 80*e* that is formed by bending a portion between the upper end portion 80*a* and the lower end portion 80*b*. The protective portion 80*c* has a shape that extends substantially vertically upward from the lower end portion 80*b*, extends toward the inside of the main body portion 6 at the bent portion 80*e*, and has the upper end portion 80*a* at an end portion thereof. As a result, in the protective portion 80*c*, a space between the upper end portion 80*a* and the bent portion 80*e* forms an upper protective portion 80*f* facing an upper part of the first air vent 73*a* and the second air vent 73*b*, and a space between the lower end portion 80*b* and the bent portion 80*e* forms a side protective portion 80*g* facing the first air vent 73*a* and the second air vent 73*b*. In the handle portion 8*a* and the handle portion 8*b*, the side protective portion 80*g* extends substantially vertically upward from the lower end portion 80*b*, and the upper protective portion 80*f* extends inward from the bent portion 80*e* toward the upper surface portion 70 of the cover portion 7.

The gripping portion 80*d* has a shape that couples the two protective portions 80*c*, and in this embodiment, couples the bent portions 80*e* of the protective portions 80*c*.

The upper end portion 80*a* of the handle portion 8*a* is fixed to one end side of the upper surface portion 70 of the cover portion 7 with screws 82. Further, the lower end portion 80*b* of the handle portion 8*a* is fixed to an attachment portion 52*b* provided on one end side in the longitudinal direction of the tank 50 in the storage unit 5 together with the cover portion 7 by a screw (not shown).

When the handle portion 8*a* is attached to the cover portion 7 and the main body portion 6 (the storage unit 5), the two protective portions 80*c* and the gripping portion 80*d* cover a portion on a front surface side of the first air vent 73*a* along the rotation axis direction 40 of the air blowing unit 4. In the protective portion 80*c*, the upper protective portion 80*f* between the upper end portion 80*a* and the bent portion 80*e* faces the upper part of the first air vent 73*a*, and the side protective portion 80*g* between the lower end portion 80*b* and the bent portion 80*e* faces the first air vent 73*a*.

As a result, the handle portion 8*a* protects the first air vent 73*a* by reducing contact of any object from a side surface and an upper surface of the first air vent 73*a*.

In the handle portion 8*a*, the protective portion 80*c* has a protruding shape at the bent portion 80*e* with respect to the air vent forming portion 72*a* which has a recessed shape, the protective portion 80*c* (the upper protective portion 80*f* and the side protective portion 80*g*) is provided apart from the first air vent 73*a*, and a space is formed between the protective portion 80*c* and the first air vent 73*a*. As a result, the handle portion 8*a* does not block a flow of air sucked into the cover portion 7 through the first air vent 73*a*.

Accordingly, as compared with a configuration in which the first air vent 73*a* is directly reinforced, the first air vent 73*a* may be protected by the handle portion 8*a* without reducing the opening area of the first air vent 73*a*.

The upper end portion 80*a* of the handle portion 8*b* is fixed to the other end side of the upper surface portion 70 of the cover portion 7 with screws 82. Further, the lower end portion 80*b* of the handle portion 8*b* is fixed to an attachment portion 52*b* provided on the other end side in the longitudinal direction of the tank 50 in the storage unit 5 together with the cover portion 7 by a screw (not shown).

When the handle portion 8*b* is attached to the cover portion 7 and the main body portion 6 (the storage unit 5), the two protective portions 80*c* and the gripping portion 80*d* cover a portion on a front surface side of the second air vent 73*b* along the rotation axis direction 40 of the air blowing unit 4. In the protective portion 80*c*, the upper protective portion 80*f* between the upper end portion 80*a* and the bent portion 80*e* faces the upper part of the second air vent 73*b*, and the side protective portion 80*g* between the lower end portion 80*b* and the bent portion 80*e* faces the second air vent 73*b*.

As a result, the handle portion 8*b* protects the second air vent 73*b* by reducing contact of any object from a side surface and an upper surface of the second air vent 73*b*.

In the handle portion 8*b*, the protective portion 80*c* has a protruding shape at the bent portion 80*e* with respect to the air vent forming portion 72*b* which has a recessed shape, the protective portion 80*c* (the upper protective portion 80*f* and the side protective portion 80*g*) is provided apart from the second air vent 73*b*, and a space is formed between the protective portion 80*c* and the second air vent 73*b*. As a result, the handle portion 8*b* does not block a flow of air discharged from the second air vent 73*b*.

Accordingly, as compared with a configuration in which the second air vent 73*b* is directly reinforced, the second air vent 73*b* may be protected by the handle portion 8*b* without reducing the opening area of the second air vent 73*b*.

The handle portion 8*a* and the handle portion 8*b* secure strength by increasing a thickness of each portion so that the heavy air compressor 1A may be carried. Further, the handle portion 8*a* and the handle portion 8*b* may secure the strength by coupling the two protective portions 80*c* by the gripping portion 80*d* at the position of the bent portion 80*e* between the upper end portion 80*a* and the lower end portion 80*b*. The upper end portions 80*a* of the handle portions 8*a* and 8*b* are coupled to the upper surface portion 70 of the cover portion 7.

In a configuration in which the periphery of an air vent is not protected by a handle in a cover portion of an air compressor having the air vent, for example, when a load is applied to the cover portion from above, the vicinity of the air vent having low strength is particularly largely deformed, and the vicinity of the air vent is easily damaged. In contrast, the upper surface portion 70 of the cover portion 7 and the lower end side of the cover portion 7 coupled to the storage unit 5 are coupled by the handle portion 8*a* and the handle portion 8*b* with secured strength, so that rigidity of the cover portion 7 is increased, and damage due to deformation of the cover portion 7 may be reduced.

In the handle portion 8*a* and the handle portion 8*b*, the upper protective portion 80*f* extends obliquely upward with respect to a horizontal direction from the bent portion 80*e*, and the upper end portion 80*a* is fixed to the upper surface portion 70 of the cover portion 7. As a result, a load applied to the upper surface portion 70 of the cover portion 7 may be transmitted to the storage unit 5 to which the respective lower end portions 80*b* of the handle portions 8*a* and 8*b* are fixed while reducing a load applied to the handle portions 8*a* and 8*b*.

The upper surface portion 70 of the cover portion 7 has a shape having a flat surface of a predetermined size at least in part, and may be used as a table on which a tool or the like is placed. Further, the upper surface portion 70 of the cover portion 7 is provided with uneven ribs 70*a* to increase the strength of the upper surface portion 70. As a result, when a tool or the like is placed on the upper surface portion 70 of the cover portion 7, a load of the tool or the like is reduced by being absorbed due to deformation of the upper surface portion 70 of the cover portion 7, and the load is transmitted to the handle portions 8*a*, 8*b*, thereby reducing damage to the cover portion 7. Further, when the upper protective portion 80*f* of the handle portion 8*a* and the handle portion 8*b* extends horizontally, an area of the upper surface portion 70 of the cover portion 7 forming the flat surface may be expanded.

Modification of Air Compressor According to Present Embodiment

Figure 3A:
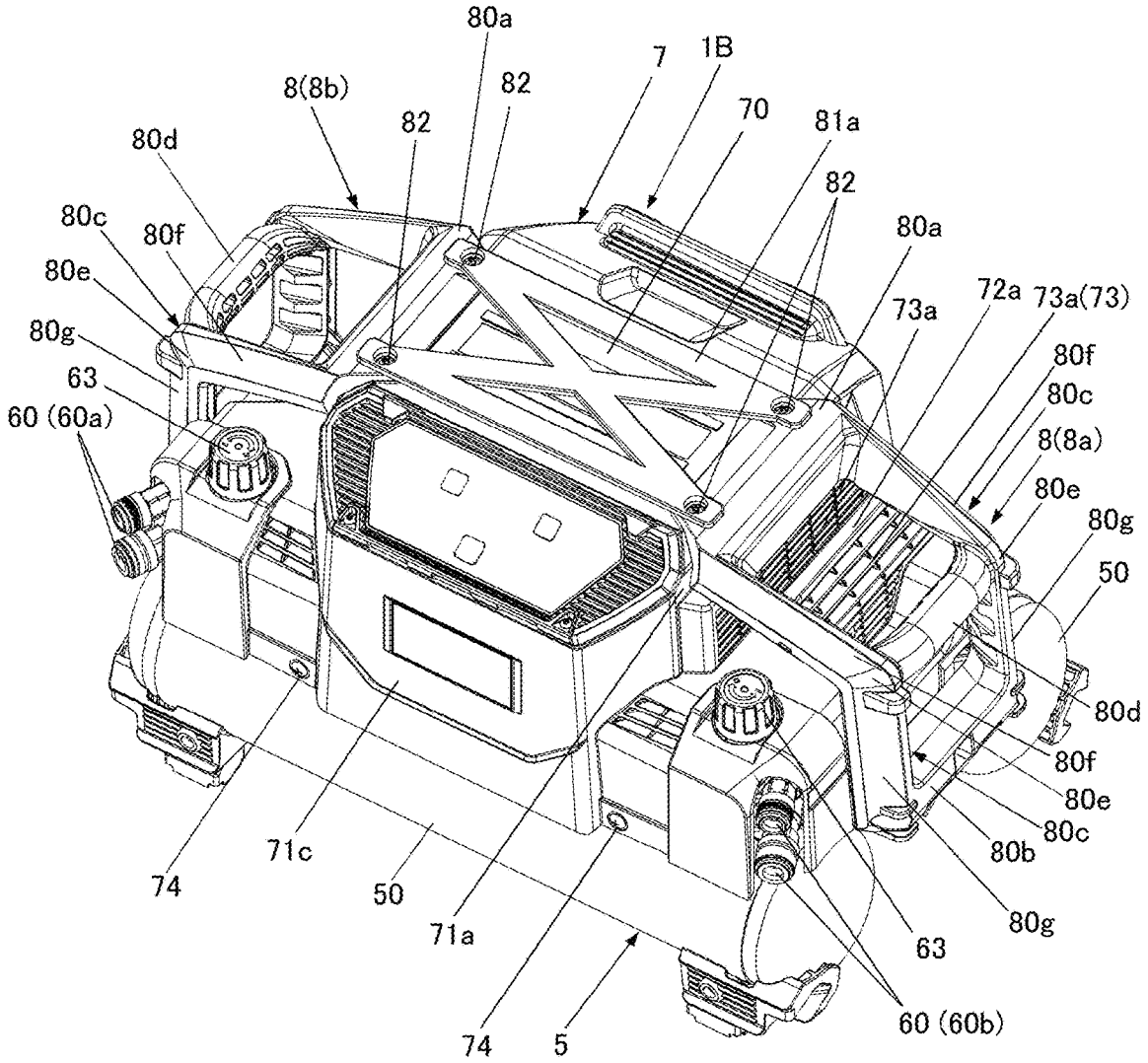
FIG. 3A is a perspective view illustrating a modification of the air compressor according to the present embodiment.
Figure 3B:
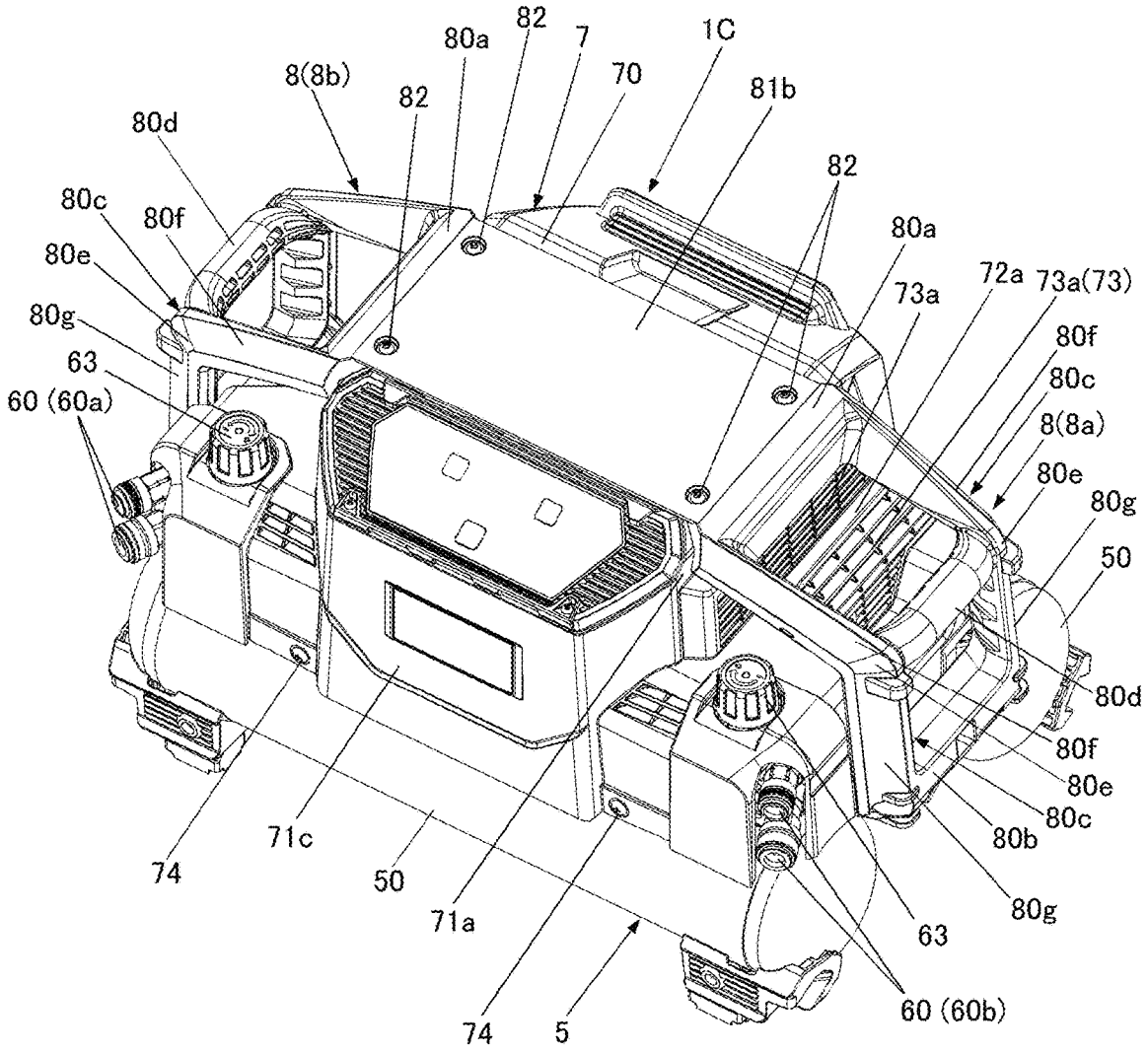
FIG. 3B is a perspective view illustrating a modification of the air compressor according to the present embodiment.
Figure 3C:
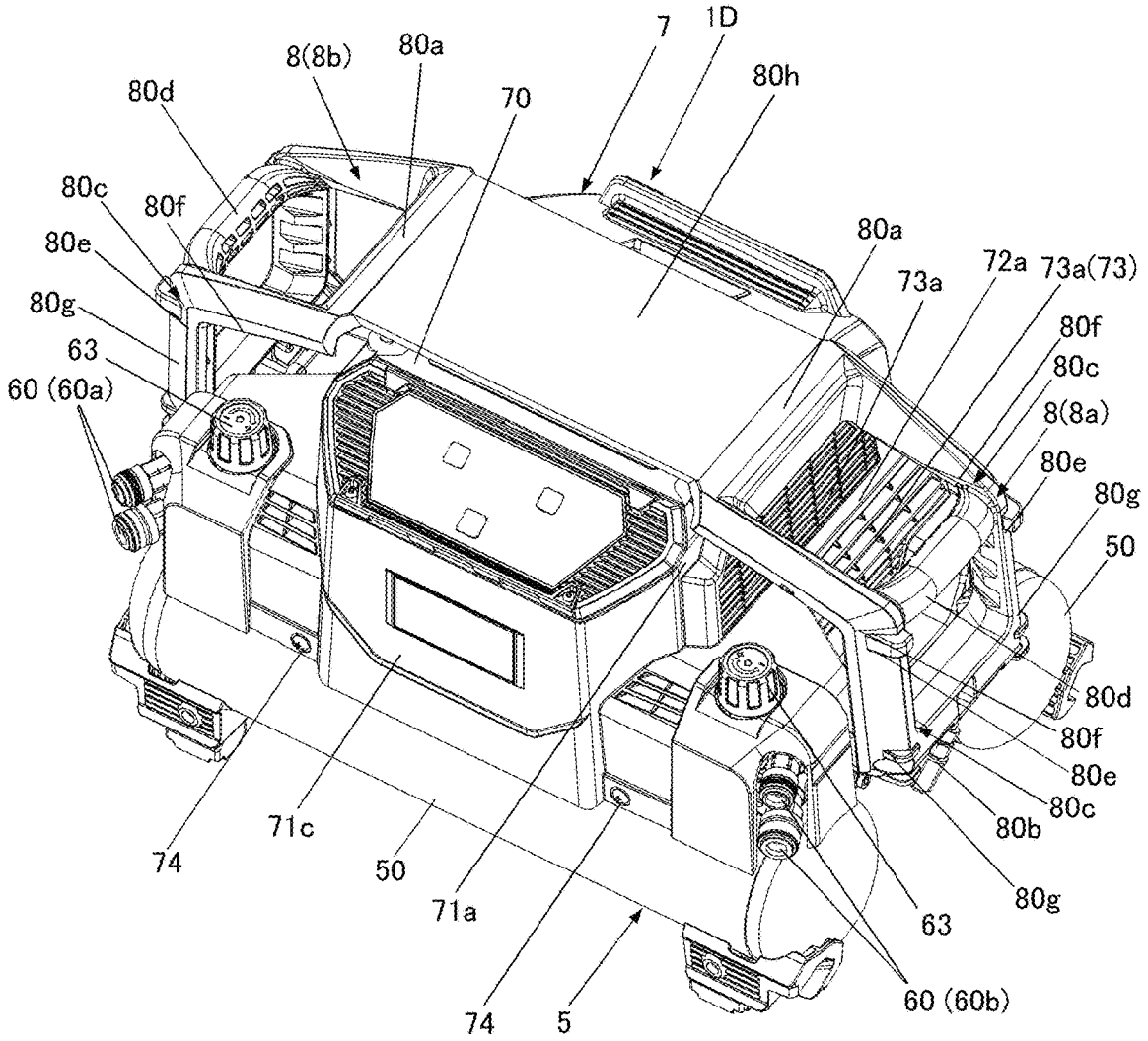
FIG. 3C is a perspective view illustrating a modification of the air compressor according to the present embodiment.

FIGS. 3A, 3B, and 3C are perspective views illustrating a modification of the air compressor according to the present embodiment.

An air compressor 1B illustrated in FIG. 3A includes a coupling member 81*a* that couples the upper end portion 80*a* of the handle portion 8*a* that partially covers the first air vent 73*a* and the upper end portion 80*a* of the handle portion 8*b* that partially covers the second air vent 73*b*. An air compressor 1C illustrated in FIG. 3B includes a coupling member 81*b* that couples the upper end portion 80*a* of the handle portion 8*a* that partially covers the first air vent 73*a* and the upper end portion 80*a* of the handle portion 8*b* that partially covers the second air vent 73*b*.

The coupling members 81*a* and 81*b* are fixed to the upper surface portion 70 of the cover portion 7 by the screws 82 together with the upper end portions 80*a* of the handle portions 8*a* and 8*b*. As a result, the upper end portions 80*a* of the handle portions 8*a* and 8*b* are coupled via the upper surface portion 70 of the cover portion 7 and the coupling members 81*a* and 81*b*. Therefore, the strength of the pair of handle portions 8*a* and 8*b* provided to face each other in the rotation axis direction 40 of the air blowing unit 4 may be ensured. In addition, the handle portions 8*a* and 8*b* and the coupling members 81*a* and 81*b* are fixed to the upper surface portion 70 of the cover portion 7, so that the rigidity of the cover portion 7 may be increased, and damage due to deformation of the cover portion 7 may be reduced. The coupling member 81*b* is made of a flat plate-shaped member having a flat surface of a predetermined size, so that a portion having a flat surface may be configured on an upper surface of the air compressor 1C, and the portion may be used as a table on which a tool or the like is placed.

In an air compressor 1D illustrated in FIG. 3C, the handle portion 8*a* that partially covers the first air vent 73*a* and the handle portion 8*b* that partially covers the second air vent 73*b* are integrally formed by a coupling portion 80*h*. The coupling portion 80*h* couples the upper end portion 80*a* of the handle portion 8*a* and the upper end portion 80*a* of the handle portion 8*b* and covers the upper surface portion 70 of the cover portion 7.

As a result, the handle portion 8*a* and the handle portion 8*b* are coupled integrally, so that the strength of the pair of handle portions 8*a* and 8*b* which are provided to face each other in the rotation axis direction 40 of the air blowing unit 4 may be ensured. The coupling portion 80*h* is formed of a flat plate-shaped member having a flat surface of a predetermined size, so that a portion having a flat surface may be configured on an upper surface of the air compressor 1D, and the portion may be used as a table on which a tool or the like is placed.

What is claimed is:

1. A gas compressor comprising:

a main body portion including:

a compression unit configured to compress gas, the compression unit comprising cylinders including pistons;

an axial fan; and a motor configured to drive the compression unit and the axial fan;

a cover portion covering at least a part of the main body portion and having an air vent through which air flows; and a handle portion having a gripping portion, wherein the air vent faces a rotation axis direction of a rotation member of the axial fan which is rotated by being driven by the motor, wherein the handle portion includes a protective portion facing the air vent and being apart from the air vent, and wherein the protective portion includes an upper protective portion extending upward to an upper surface portion of the cover portion to face and cover an upper portion of the air vent.

2. The gas compressor according to claim 1, wherein the protective portion includes a side protective portion facing a front portion of the air vent, and wherein the upper protective portion and the side protective portion are apart from the air vent.

3. The gas compressor according to claim 1, wherein an upper end side of the protective portion includes an upper end portion configured to be fixed to the upper surface portion of the cover portion, and a lower end side of the protective portion includes a lower end portion configured to be fixed to the main body portion.

4. The gas compressor according to claim 1, wherein the protective portion includes two protective portions, the two protective portions being located a distance from each other, a length of the distance being substantially the same as a width of the air vent.

5. The gas compressor according to claim 1, wherein the cover portion includes a first side portion on a first side of the rotation member, and a second side portion on a second side of the rotation member, the first and second side portions facing the rotation axis direction, and wherein the protective portion includes two protective portions, a first protective portion of the two protective portions is disposed on the first side portion, and a second protective portion of the two protective portions is provided on the second side portion of the cover portion.

6. The gas compressor according to claim 5, wherein the handle portion includes a coupling portion that covers and is coupled with at least a part of the upper surface portion of the cover portion.

7. The gas compressor according to claim 5, wherein the handle portion is coupled with the cover portion with a coupling member that covers at least a part of the upper surface portion of the cover portion.

8. The gas compressor according to claim 1 further comprising one or more tanks configured to store the gas compressed by the compression unit, wherein the rotation axis direction of the rotation member is parallel to a longitudinal direction of the one or more tanks.

9. The gas compressor according to claim 1, wherein the cover portion covers a side face of the main body portion.

10. The gas compressor according to claim 4, the gripping portion is disposed between the two protective portions.

11. The gas compressor according to claim 1, the protective portion includes a first portion extending along the rotation axis direction of the rotation member and a second portion extending downward from an end portion of the first portion.

12. The gas compressor according to claim 11, the gripping portion laterally extends from the end portion of the first portion.

13. The gas compressor according to claim 1, wherein the upper protective portion extends obliquely upward, relative to a horizontal direction, to the upper surface portion of the cover portion.

* * * * *